US007976364B2

(12) United States Patent
Roehm

(10) Patent No.: US 7,976,364 B2
(45) Date of Patent: Jul. 12, 2011

(54) DUST-COLLECTION CONTAINER

(75) Inventor: Heiko Roehm, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 283 days.

(21) Appl. No.: 12/374,680

(22) PCT Filed: Feb. 19, 2008

(86) PCT No.: PCT/EP2008/051957

§ 371 (c)(1),
(2), (4) Date: Jan. 22, 2009

(87) PCT Pub. No.: WO2008/128798

PCT Pub. Date: Oct. 30, 2008

(65) Prior Publication Data

US 2009/0270018 A1 Oct. 29, 2009

(30) Foreign Application Priority Data

Apr. 18, 2007 (DE) ..... 10 2007 018 234

(51) Int. Cl.
*B24B 55/10* (2006.01)
*B24B 23/00* (2006.01)

(52) U.S. Cl. ..... 451/453; 451/359

(58) Field of Classification Search ..... 451/453, 451/456, 357, 359

See application file for complete search history.

(56) References Cited

U.S. PATENT DOCUMENTS

| | | | | |
|---|---|---|---|---|
| 4,839,995 | A | 6/1989 | Hutchins | |
| 5,440,809 | A * | 8/1995 | Padilla | 30/124 |
| 6,514,131 | B1 | 2/2003 | Reich et al. | |
| 2005/0202767 | A1 | 9/2005 | Reich et al. | |

FOREIGN PATENT DOCUMENTS

| | | |
|---|---|---|
| DE | 199 24 547 | 11/2000 |
| DE | 102 49 140 | 5/2004 |
| EP | 1 477 273 | 11/2004 |
| WO | 02/081148 | 10/2002 |

* cited by examiner

*Primary Examiner* — Robert Rose
(74) *Attorney, Agent, or Firm* — Michael J. Striker

(57) ABSTRACT

The invention relates to a dust collection container for a hand-held power tool, especially an electric sander, having a dust extraction connection (12). Said dust collection container has an inlet connection (17) configured to be slid onto the dust extraction connection (12) and a seal (18) that is effective between the inlet connection (17) and the dust extraction connection (12), the peripheral surface (182) of said seal sealingly fitting against the inner wall (172) of the inlet connection (17). In order to facilitate an easy and jerk-free handling of the dust collection box during attachment to the hand-held power tool and during detachment of the hand-held power tool, the seal (18) has a sealing surface (181) which is oriented at a right angle to the connection axis and which is configured to sealingly fit against the free, annular face (121) of the dust extraction connection (12).

4 Claims, 1 Drawing Sheet

DUST-COLLECTION CONTAINER

BACKGROUND INFORMATION

The present invention is directed to a dust-collection container for a hand-held power tool which includes a dust-discharge adapter, in particular for use with an electrical hand-held sander, according to the preamble of claim 1.

A known dust-collection container for an electrical hand-held power tool (DE 102 49 140 A1) includes a dust-collection chamber and an intake adapter which extends along the base of the dust-collection chamber and leads into the dust-collection chamber. The dust-collection chamber which is open toward the top is closed using a removable cover which includes air-outlet openings, on the underside of which a dust filter is provided. To use the dust-collection container on the electrical hand-held power tool, the dust-collection container is slid via its intake adapter onto the dust-discharge adapter of the electrical hand-held power tool, and the dust-collection container is locked in its end position—after having been slid into place—using a latch hook on the machine housing, which latches into place automatically. A seal between the dust-discharge adapter and the intake adapter creates the dust-proof connection of the dust-collection container on the electrical hand-held power tool. The seal is composed of two O-rings, one of which rests in one of two interspaced circumferential grooves formed in the dust-discharge adapter and presses against the inner wall of the intake adapter.

DISCLOSURE OF THE INVENTION

The dust-collection container according to the present invention having the features of claim 1 has the advantage that the sealing surface of the dust seal which rests on the dust-discharge adapter of the hand-held power tool and acts on it with sealing force is oriented transversely to the axis of the intake adapter and, therefore, transversely to the direction in which the dust-collection container is slid into place. The seal is therefore prevented from creating a friction force on the dust-discharge adapter when the intake adapter is slid into place, and no friction force is created on the seal by the intake adapter when it is slid off, thereby ensuring that the dust-collection container may be attached to or removed from the hand-held power tool in a smooth manner. The intake adapter may therefore always be slid onto or off of the dust-discharge adapter in a straight line, and it need not be rotated back and forth in alternation on the dust-discharge adapter in order to overcome a friction force when it is slid on or off. The dust-collection container therefore does not require any play when it is slid on or off. It is therefore not necessary to make any compromises in the compact design of the dust-collection container and the hand-held power tool.

Due to the measures listed in the further claims, advantageous developments and improvements of the dust-collection container described in claim 1 are made possible.

According to a preferred embodiment of the present invention, a compression spring bears against the back side of the seal which faces away from the sealing surface, the compression spring bearing against a radial shoulder formed in the intake adapter. The compression spring, which becomes increasingly loaded when the intake adapter is slid onto the dust-discharge adapter, generates a high axial sealing force which presses the seal axially against the annular, free end face of the dust-discharge adapter. As a result, the circumferential surface of the seal is pressed with greater force against the inner wall of the intake adapter. In addition, the compression force of the compressed compression spring supports the removal of the intake adapter from the discharge adapter, thereby ensuring that the dust-collection container may be removed from the hand-held power tool in a smooth manner.

BRIEF DESCRIPTION OF THE DRAWING

The present invention is described in greater detail in the description below with reference to an embodiment shown in the drawing.

Figure 1:
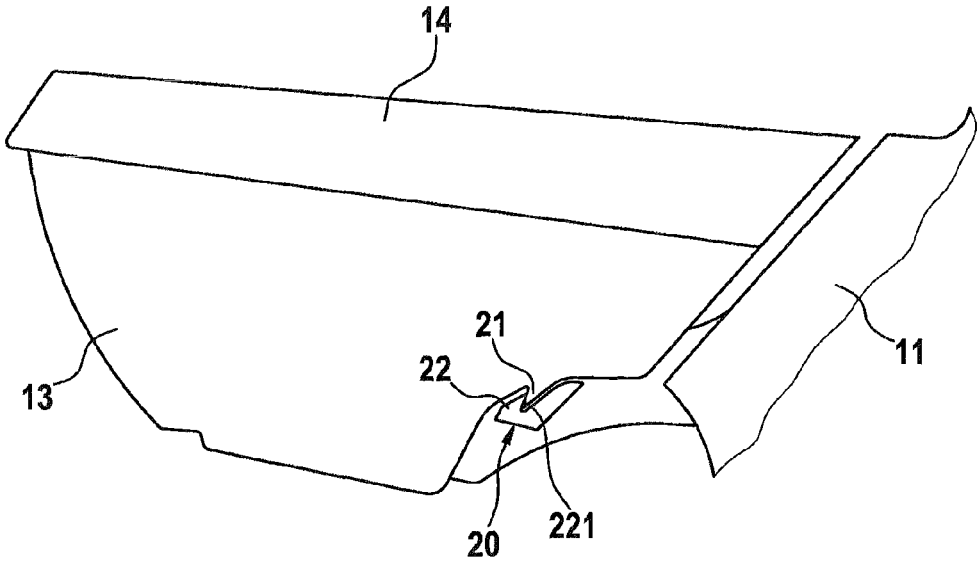
FIG. 1 shows a side view of a dust-collection container attached to a hand-held power tool; the only portion of the hand-held power tool which is shown is a section of the machine housing.
Figure 2:
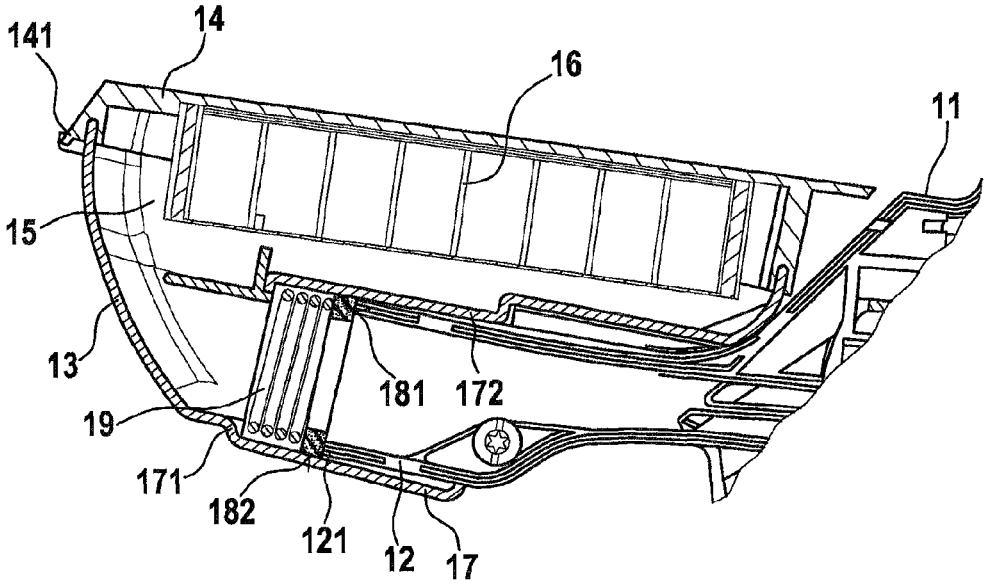
FIG. 2 shows a longitudinal sectional view of the dust-collection container in FIG. 1, after it has been attached to the hand-held power tool.

The dust-collection container—shown in a side view in FIG. 1 and in a longitudinal view in FIG. 2—for a hand-held power tool which includes a material-removing tool, e.g. an electrical hand-held power tool, such as a finishing sander, an eccentric grinder, or a belt sander, or for a hand-held sawing machine or a power planer, is designed to be attached to and removed from machine housing 11 of the hand-held power tool in the region of a dust-discharge adapter 12 of the hand-held power tool, which is formed on machine housing 11. The dust-collection container includes a tub-shaped housing 13 which is open at the top, and a cover 14 which may be placed on the opening of housing 13. Cover 14 closes housing 13 in a dust-proof manner and, together with housing 13, encloses a dust-collection chamber 15. Ventilation openings (not depicted) are formed in cover 14 in FIGS. 1 and 2. To seal off dust, cover 14 includes a circumferential elastic edge 141, on the end surface of which a groove is formed. Via this end groove, edge 141 of cover 14 is pressed onto the end edge of housing 13, which encloses the housing opening. The underside of cover 14 which faces dust-collection chamber 15 is provided with a dust filter 16, which is designed as a pleated filter in the embodiment. An intake adapter 17 which leads into dust-collection chamber 15 is integrated in the bottom of housing 13. The dust-collection chamber has been slid onto dust-discharge adapter 12 of the hand-held power tool via intake adapter 17. To provide a seal against dust at the interface between the dust-collection container and the hand-held power tool, an annular seal 18 is provided in intake adapter 17, which bears via circumferential surface 182 against inner wall 172 of intake adapter 17, and which is pressed by a compression spring 19—via its sealing surface 181 which is oriented transversely to the axis of inlet adapter 17—against the annular, free end of dust-discharge adapter 12. Via the compression force of compression spring 19 which bears against a circumferential radial shoulder 171 in intake adapter 17, seal 18 is pressed via its circumferential surface 182 against inner wall 172 of intake adapter 17 with greater force. Due to this design of the dust seal, when intake adapter 17 is slid onto dust-discharge adapter 12, and when intake adapter 17 is removed from dust-discharge adapter 12, no frictional forces—or no notable frictional forces—between adapters 12, 17 caused by seal 18 need be overcome, and smooth handling of the dust-collection container in terms of attaching it and removing it is ensured. Compression spring 19 is strong enough that seal 18 may be displaced in intake adapter 17, thereby ensuring that it is always reliably positioned on the end surface of intake adapter 17.

In its operable connection to hand-held power tool, the dust-collection container is fixed to machine housing 11 via a latched connection 20 indicated in FIG. 1, one latched connection 20 each being provided on lateral faces of machine housing 11 and housing 13 which face away from one another. Each latched connection 20 is composed of a latch hook 21 located on housing 13 of the dust-collection container, and a snap-in projection 22 with rearward cut-out section 221, which is located on a machine housing 11.

To attach the dust-collection container to the hand-held power tool, the dust-collection container is slid via its intake adapter 17 onto dust-discharge adapter 12. After a short sliding-on path, seal 18 bears via its sealing surface 181 against the end face of dust-discharge adapter 12 and, as it is slid further, it is pressed by compressing compression spring 19 against end face 121. As the compressive force of compression spring 19 increases, circumferential surface 182 of seal 18 presses with greater force against inner wall 172 of intake adapter 17. At the end of the sliding-on motion, latch hook 21 passes over snap-in projection 22 and latches in rearward cut-out section 221.

To remove the dust-collection container from the hand-held power tool, the dust-collection container is slid slightly, by hand, in the sliding-on direction, i.e. toward machine housing 11, which is possible since compression spring 19 is compressed further. As a result, latch hook 21 detaches from rearward cut-out section 221. Latch hook 21 may be moved out of rearward cut-out section 221 by rotating the dust-collection container slightly. Compression spring 19, which is decompressing, now pushes the dust-collection container back slightly onto dust-discharge adapter 12, and the dust-collection container may be easily removed.

As an alternative, latch hooks 21 may also be designed as spring-action pawls which automatically engage in rearward cut-out section 221 via spring force. The placement of latch hooks 21 and snap-in projections 22 on housing 13 of the dust-collection container and on machine housing 11 may also be reversed.

In a simplified embodiment, compression spring 19 may be eliminated, and annular seal 18 may be placed via its back side—which faces away from sealing surface 181—on a support bearing, e.g. a radial segment, which is formed in intake adapter 17. When the support bearing is situated accordingly, seal 18 is pressed via latch hooks 21 which drop behind snap-in projections 22 onto end face 121 of dust-discharge adapter 12. The seal is compressible in an axially elastic manner since it is composed of a suitable material, e.g. PUR foam, or due to appropriate geometric shaping.

What is claimed is:

1. A dust-collection container for a hand-held power tool which includes a dust-discharge adapter (12), in particular for an electrical hand-held sander, having an intake adapter (17) which is designed to be slid onto the dust-discharge adapter (12), and having a seal (18) which is operative between the intake adapter (17) and the dust-discharge adapter (12), and which provides a seal via its circumferential surface (182) against the inner wall (172) of the intake adapter (17), wherein the seal (18) includes a sealing surface (181) which is oriented transversely to the adapter axis, and which includes a back side that faces away from the sealing surface (181) and wherein a support bearing configured as a compression spring (19) bears against the back side of the seal (18) and against a radial shoulder (171) formed in the intake adapter (17) to provide a seal against the free end face (121) of the dust-discharge adapter (12).

2. The dust-collection container as recited in claim 1, wherein the compressive force of the compression spring (19) is greater than a friction force which occurs between the seal (18) and the inner wall (172) of the intake adapter (17).

3. The dust-collection container as recited in claim 1, wherein at least one latch hook (21) establishes a latched connection (20) between the dust connection container and the hand-held power tool via a snap-in projection (22) on the machine side when the intake adapter (17) is in its end position after having been slid into place, wherein the latched connection (20) is designed in a manner such that the latch hook (21) automatically drops behind the snap-in projection (22) when the intake adapter has reached its end position after having been slid into place and wherein the latched connection (20) is disconnected by pushing the dust-collection container forward in the sliding-on direction, against the spring force of the compression spring (19).

4. The dust-collection container as recited in claim 3, wherein the snap-in projection (22) on the machine side includes a rearward cut-out section (221) into which the latch hook (21) may engage.

* * * * *